US010739704B2

(12) United States Patent
Sandler et al.

(10) Patent No.: US 10,739,704 B2
(45) **Date of Patent: *Aug. 11, 2020**

(54) IMAGE TRANSFER FOR LIQUID ELECTRO-PHOTOGRAPHIC PRINTING

(71) Applicant: HP INDIGO B.V., Amstelveen (NL)

(72) Inventors: Mark Sandler, Rehovot (IL); Peter Nedelin, Ashdod (IL); Shai Lior, Rehovot (IL)

(73) Assignee: HP Indigo B.V., Amstelveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/534,529

(22) Filed: Aug. 7, 2019

(65) Prior Publication Data

US 2019/0361377 A1 Nov. 28, 2019

Related U.S. Application Data

(63) Continuation of application No. 16/193,377, filed on Nov. 16, 2018, now Pat. No. 10,437,174, which is a continuation of application No. 15/545,913, filed as application No. PCT/EP2015/054761 on Mar. 6, 2015, now Pat. No. 10,156,815.

(51) Int. Cl.

| | |
|---|---|
| ***G03G 15/16*** | (2006.01) |
| ***G03G 15/10*** | (2006.01) |
| *G03G 15/11* | (2006.01) |

(52) U.S. Cl.

CPC ..... *G03G 15/104* (2013.01); *G03G 15/10* (2013.01); *G03G 15/161* (2013.01); *G03G 15/11* (2013.01); *G03G 15/169* (2013.01)

(58) Field of Classification Search

CPC ..... G03G 15/10; G03G 15/104; G03G 15/11; G03G 15/161; G03G 15/169; G03G 16/1605

USPC ..... 399/16, 38, 66, 107, 110, 121, 297, 302, 399/307

See application file for complete search history.

(56) References Cited

U.S. PATENT DOCUMENTS

| | | | |
|---|---|---|---|
| 6,386,696 | B1 | 5/2002 | Rodi et al. |
| 7,502,042 | B2 | 3/2009 | Hitz et al. |

(Continued)

FOREIGN PATENT DOCUMENTS

| | | |
|---|---|---|
| CN | 101887220 | 11/2010 |
| CN | 102163016 | 8/2011 |

(Continued)

OTHER PUBLICATIONS

Pettersson, Torbjorn. "Wetting and leveling of toner during fusing of electrophotographic prints." PhD diss., (2004) Kemi, 48 pages.

*Primary Examiner* — Hoan H Tran

(74) *Attorney, Agent, or Firm* — Steven Ormiston

(57) ABSTRACT

In one example, a system for transferring an image from a photoconductor to a print substrate includes a transfer member having a removable blanket wrapped around a rotatable drum and a laser. The blanket has a light absorbing exterior surface to receive a liquid LEP ink image from the photoconductor and to release a layer of molten toner to a print substrate. As the drum rotates, the laser exposes a width of the exterior surface of the blanket carrying a liquid LEP ink image to a beam of coherent light that delivers enough power to transform the liquid LEP ink image into molten toner.

9 Claims, 6 Drawing Sheets

(56) References Cited

U.S. PATENT DOCUMENTS

| | | | | |
|---|---|---|---|---|
| 8,985,022 | B2 | 3/2015 | Sandler | |
| 9,304,465 | B2 | 4/2016 | Lopez | |
| 9,383,687 | B2 | 7/2016 | Nedelin | |
| 10,156,815 | B2 | 12/2018 | Sandler | |
| 10,437,174 | B2 * | 10/2019 | Sandler | G03G 15/10 |
| 2005/0025534 | A1 | 2/2005 | Fujita et al. | |
| 2010/0067950 | A1 * | 3/2010 | Toyama | G03G 15/10<br>399/159 |
| 2011/0058867 | A1 | 3/2011 | Kodera et al. | |
| 2012/0039649 | A1 | 2/2012 | Brewington et al. | |
| 2012/0045239 | A1 | 2/2012 | Maeda | |
| 2014/0003849 | A1 | 1/2014 | Liu | |
| 2014/0063161 | A1 | 3/2014 | Liu | |

FOREIGN PATENT DOCUMENTS

| | | |
|---|---|---|
| JP | 2007304406 | 11/2007 |
| WO | WO-201418379 | 11/2014 |

* cited by examiner

IMAGE TRANSFER FOR LIQUID ELECTRO-PHOTOGRAPHIC PRINTING

CROSS REFERENCE TO RELATED APPLICATIONS

This is a continuation of U.S. patent application Ser. No. 16/193,377 filed Nov. 16, 2018, which is itself a continuation of U.S. patent application Ser. No. 15/545,913 filed Jul. 24, 2017 (now U.S. Pat. No. 10,156,815), which is itself a Section 371 national stage of international patent application no. PCT/EP2015/054761 filed Mar. 6, 2015.

BACKGROUND

Liquid electro-photographic (LEP) printing uses a special kind of ink to form images on paper and other print substrates. LEP inks include toner particles dispersed in a carrier liquid. Accordingly, LEP ink is sometimes called liquid toner. In LEP printing processes, an electrostatic pattern of the desired printed image is formed on a photoconductor. This latent image is developed into a visible image by applying a thin layer of LEP ink to the patterned photoconductor. Charged toner particles in the ink adhere to the electrostatic pattern on the photoconductor. The liquid ink image is transferred from the photoconductor to an intermediate transfer member (ITM) that is heated to transform the liquid ink to a molten toner layer that is then pressed on to the print substrate.

DRAWINGS

The same part numbers designate the same or similar parts throughout the figures.

DESCRIPTION

Figure 1:
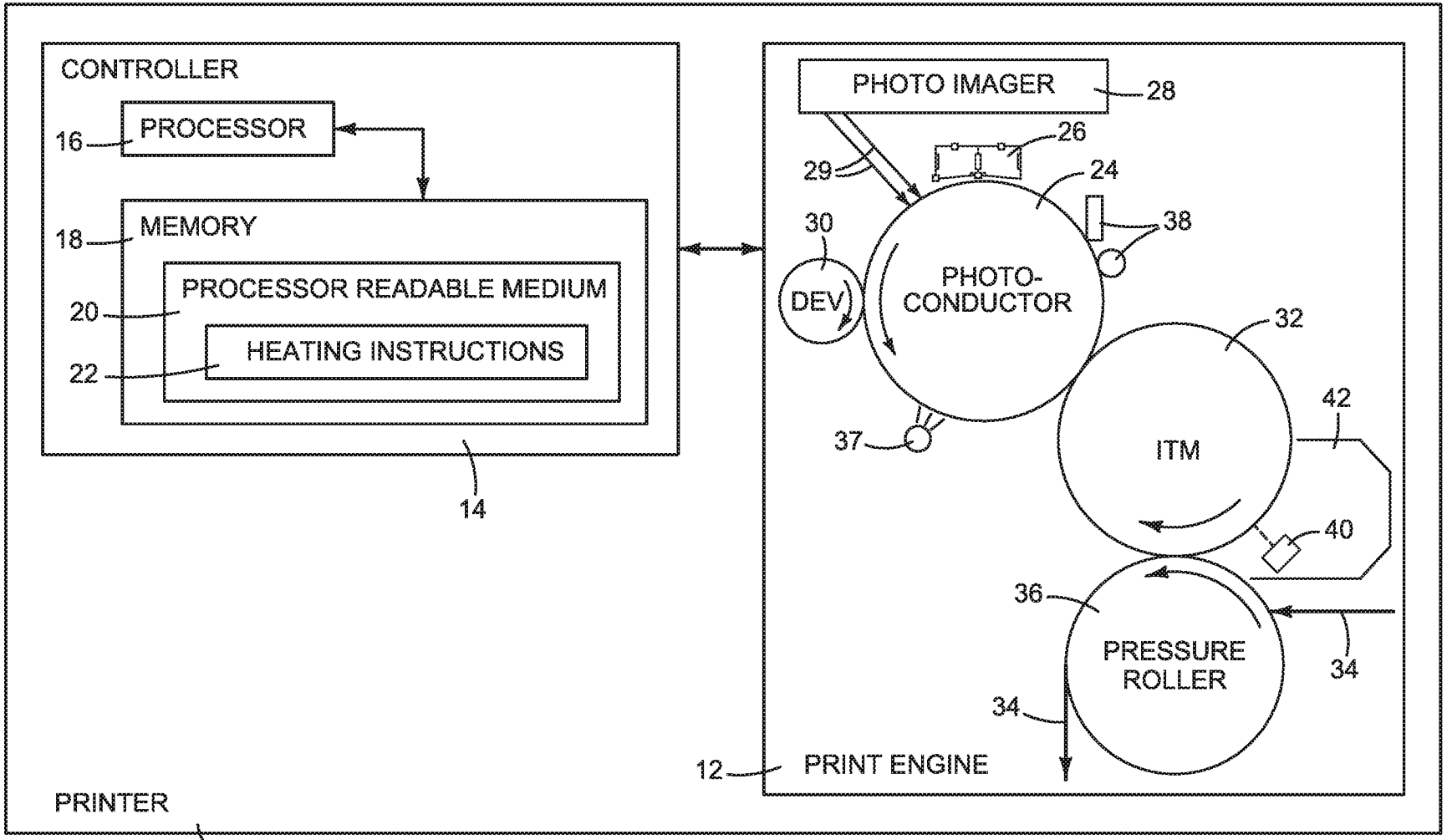
FIG. 1 is a block diagram illustrating an LEP printer implementing one example of a new ITM heater.

HP Indigo® commercial and industrial digital printing presses utilize ElectroInk® and other LEP inks developed by Hewlett-Packard Company in a thermal offset transfer process to print high quality images on a wide range of printing substrates. In one example LEP printing process, the ink image transferred from the photoconductor to the intermediate member (ITM) is about 5 μm thick with 20% toner, while the ink image transferred from the ITM to the print substrate is about 1 μm thick and nearly 100% toner. This change in thickness and concentration is achieved by heating the ITM to raise the temperature of the ink until the toner particles change phase and the carrier evaporates, transforming the liquid ink into a tacky layer of toner. In this transformed state, the toner layer adheres to the print substrate immediately on contact.

Infrared lamps are commonly used to heat the ITM from both the inside and the outside to maintain the ITM at the desired transformation temperature. Currently, the ink transformation process on the ITM takes hundreds of milliseconds and its environment sinks large amounts of heat, impeding faster printing and causing significant thermal losses.

It has been discovered that transferring the liquid ink image to an unheated ITM at ambient temperature and then rapidly raising the temperature of the ITM along a narrow band transforms the ink as desired and allows the ink transformation to occur very fast and with much smaller heat losses compared to current transfer processes. Accordingly, new ITM transfer systems and processes have been developed for fast and focused heating of the ITM. In one example, an array of lasers is arranged to direct laser beams across the surface of the ITM carrying the liquid ink image with enough power to almost instantly transform the liquid ink from a suspension of separate toner particles to a thin molten toner layer by eliminating most of the liquid carrier and melting the toner. For example, it is expected that laser beams each having an energy density at least 5 $mJ/mm^2$ will be sufficient for many LEP printing applications to make the transformation in less than 20 ms, compared to 300 ms or more in current transfer processes.

In one example of a new LEP printing process, the inked image developed on the photoconductor is transferred to an unheated part of the ITM. The ITM carrying the inked image is heated rapidly from an ambient temperature, usually 20° C. to 30° C., to a peak temperature, typically 180° C. to 220° C., in less than 10 ms to transform the inked image to a thin molten toner layer which contains mostly toner (almost without liquid carrier). The layer is then released to the print substrate. "Unheated" in this context means not actively heated. The ITM may retain heat and, thus, the ambient temperature of unheated parts of ITM may be warmer than the surrounding operating environment.

A processor readable medium with instructions for fast and focused heating of the ITM may be implemented, for example, in the controller of the LEP printer.

The examples shown in the figures and described herein illustrate but do not limit the scope of the patent, which is defined in the Claims following this Description.

As used in this document, a "laser" means a device that produces a beam of coherent light; "light" means electromagnetic radiation of any wavelength; and "LEP ink" means a liquid that includes toner particles in a carrier liquid suitable for electro-photographic printing.

Figure 2:
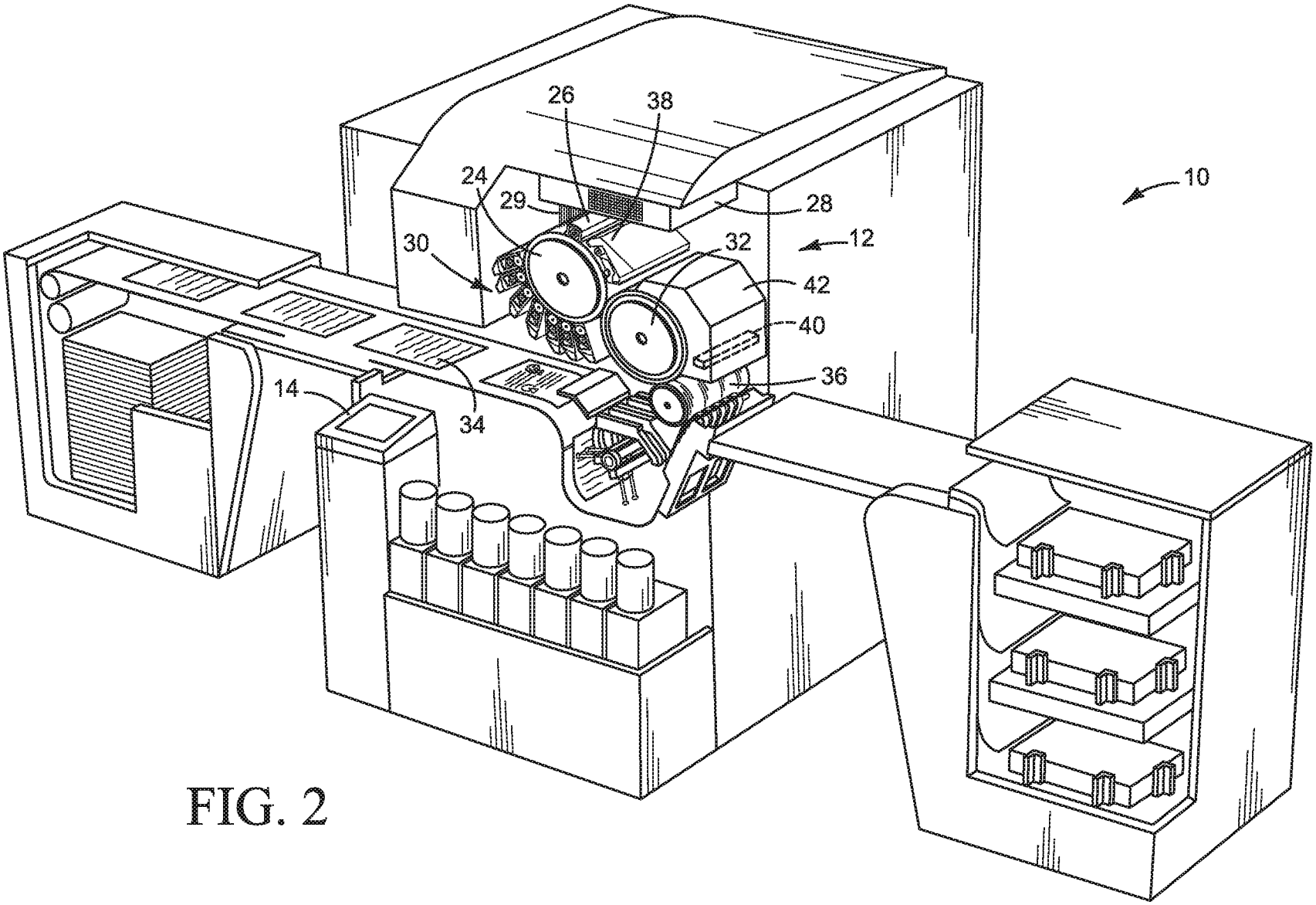
FIG. 2 is a more realistic representation of one example of an LEP printer implementing an ITM heater such as the heater shown in FIG. 1.

FIG. 1 is a block diagram illustrating an LEP printer 10 implementing one example of a new ITM heater. FIG. 2 is a more realistic representation of an LEP printer 10. Referring to FIGS. 1 and 2, printer 10 includes a print engine 12 and a controller 14 operatively coupled to print engine 12. Controller 14 represents generally the programming, processor and associated memory, and the electronic circuitry and components needed to control the operative elements of printer 10, including the elements of print engine 12. An LEP printer controller 14 may include multiple controller and microcontroller components and usually will include one or more processors 16 and associated memory(ies) 18. Processors 16 may include, for example, general purpose processors, microprocessors, and application specific integrated circuits (ASICs).

In the example shown, memory 18 includes a processor readable medium 20 with instructions 22 to control ITM heating. A processor readable medium 20 is any non-transitory tangible medium that can embody, contain, store, or maintain instructions for use by a processor 16. Processor readable media include, for example, electronic, magnetic, optical, electromagnetic, or semiconductor media. More specific examples of suitable processor readable media include a hard drive, a random access memory (RAM), a read-only memory (ROM), memory cards and sticks and other portable storage devices. Heating instructions 22 may be embodied, for example, in software, firmware, and/or hardware.

Although print engine 12 and controller 14 are shown in different blocks in FIG. 1, some of the control elements of controller 14 may reside in print engine 12, for example close to the print engine components they control or power.

In one example printing process for an LEP printer such as that shown in FIGS. 1 and 2, a uniform electric charge is applied to a photoconductor 24, the photosensitive outer surface of a cylindrical drum for example, by a scorotron or other suitable charging device 26. A scanning laser or other suitable photoimaging device 28 exposes select areas on photoconductor 24 to light 29 in a pattern of the desired ink image. A thin layer of LEP ink is applied to the patterned photoconductor 12 using a developer 30. Developer 30 represents generally a typically complex unit that supplies ink to photoconductor 24, for example through a series of corresponding rollers that rotate against the surface of the photoconductor. The ink from developer 30 adheres to the latent electrostatic image on photoconductor 24 to "develop" a liquid ink image on the photoconductor.

The liquid ink image is transferred from photoconductor 24 to an intermediate transfer member (ITM) 32 and then from ITM 32 to sheets or a web of paper or other print substrate 34 as it passes between ITM 32 and a pressure roller 36. A lamp or other suitable discharging device 37 removes residual charge from photoconductor 24 and ink residue is removed at a cleaning station 38 in preparation for developing the next ink image.

Print engine 12 also includes a heater 40 to heat ITM 32. As described in more detail below, ITM heater 40 is configured to rapidly heat a small part of ITM 32 to a temperature needed to transform the liquid ink image into a tacky layer of toner for transfer to print substrate 34. Heater 40 may be housed in an enclosure 42 to contain and evacuate vapors produced during heating.

Figure 3:
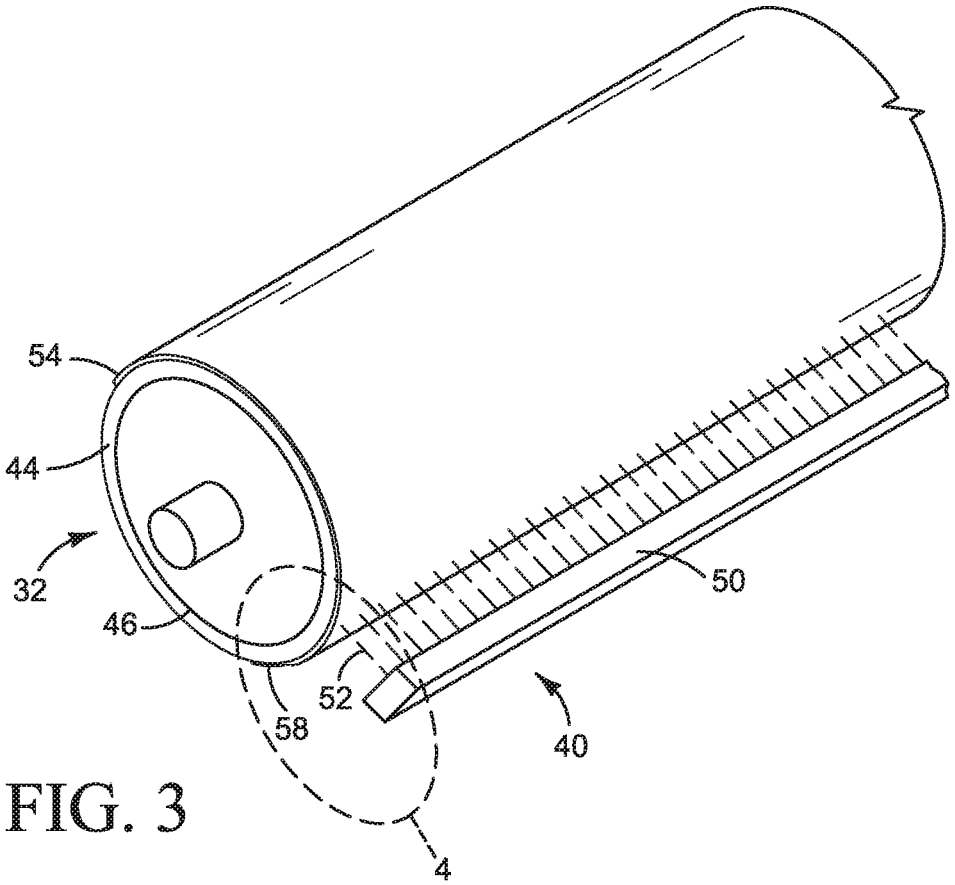
FIGS. 3 and 4 show the ITM heater of FIG. 2 in more detail.
Figure 4:
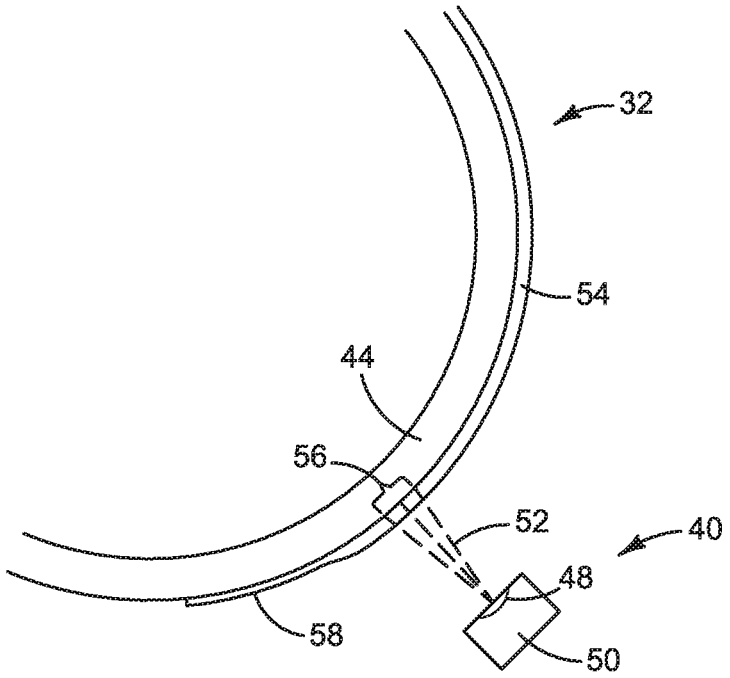
Figure 8:
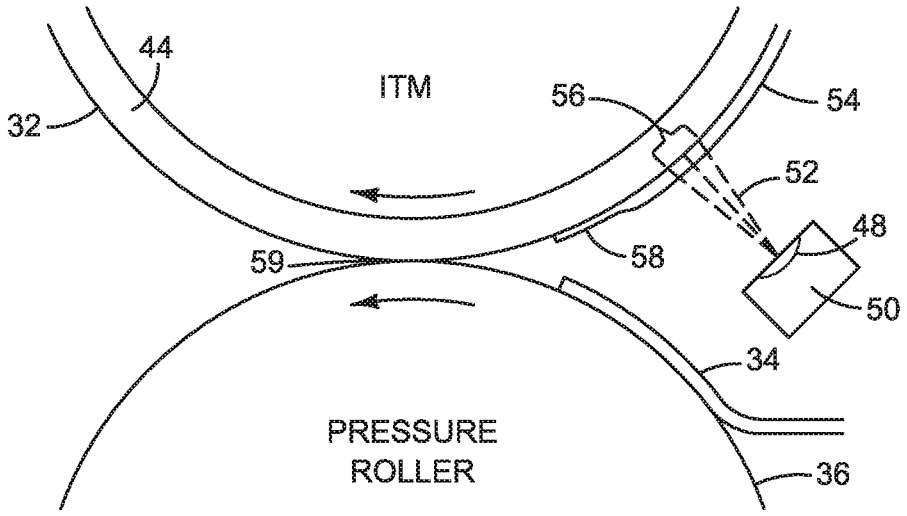
Figure 9:
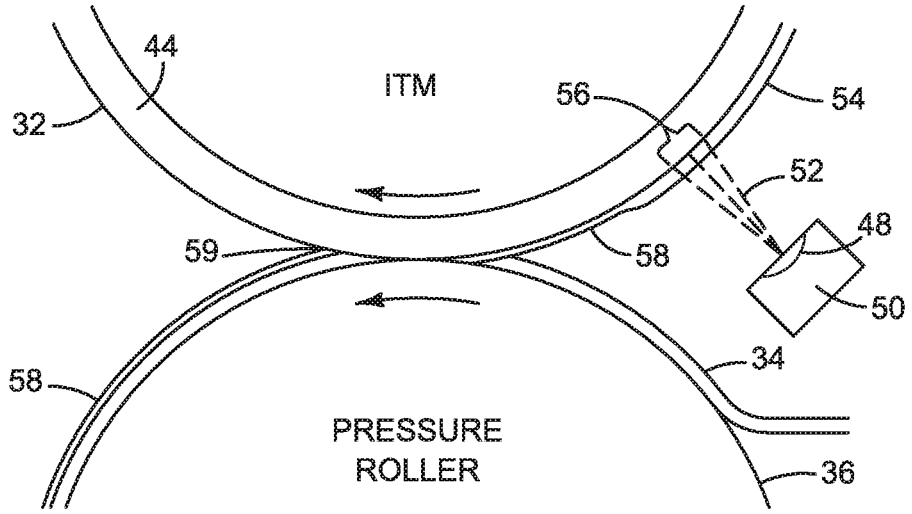

FIGS. 3 and 4 show ITM 32 and heater 40 in more detail. Referring to FIGS. 3 and 4, an ITM 32 usually will include a removable, replaceable blanket 44 wrapped around a drum 46, The comparatively soft, compliant blanket 44 is heated to transform the ink image. In one example, heater 40 is implemented as an array of lasers 48 spanning the width of ITM blanket 44. Lasers 48 usually will be assembled together in a control module or light bar 50 operatively connected to controller 14 (FIG. 1). The high power density of the light beams 52 generated by lasers 48 enables fast and focused heating of blanket 44. The surface of blanket 44 carrying the thicker, liquid ink image 54 is heated rapidly to the desired transformation temperature along a narrow band 56 to form the thinner, molten toner layer 58 right before a nip 59 with pressure roller 36. (Nip 59 is shown in FIGS. 8 and 9.)

It was discovered that transferring the liquid ink image to an unheated ITM blanket and rapidly raising the temperature of the surface of the blanket along a narrow band transforms the ink as desired and allows the ink transformation to occur very fast and with much smaller heat losses compared to the current transfer processes. Heat transfer calculations show, and testing confirms, that the time to transform the ink image from a thicker, liquid layer 54 received from the photoconductor to a thinner, tacky layer 58 transferred to the print substrate can be shortened by an order of magnitude from hundreds of milliseconds in the current transfer process to tens of milliseconds (or less) in the new transfer process. The ink is heated by conduction from the outer part of ITM blanket 44, which has a high absorption coefficient at the laser wavelengths. The bulk of ITM 32 stays relatively cool so the energy used to maintain the transformation drops substantially compared to the current process and energy losses to the environment are small. As a result, significant energy savings can be realized even with the relatively low efficiency of existing laser diodes.

In one specific example, ITM heater 40 is configured as a single row of VCSELs 48 (Vertical Cavity Surface-Emitting Lasers) emitting light beams 52 at a wavelength of 980 nm. The VCSEL module has a maximum output power of 6.4 W/mm of printing width with a power density up to 160 W/mm$^2$. nAn ITM blanket 44 currently used in LEP printers absorbs light across a wide band of wavelengths and, thus, may be used with a VCSEL type heater 40 in this example. The ITM was exposed to beams 52 for 40 μs with the post-heating time varied between 20 ms-30 ms (the time between exposure to beams 52 and contact with print substrate 34 at nip 59). Other suitable configurations are possible. For one example, other types of lasers or even non-laser, focused heat sources may be used for heater 40. The power of each laser 48 and/or the size of the array may be varied to achieve the desired heating characteristics. Also, the wavelength of light beams 52 emitted by lasers 48 and the absorption characteristics of ITM blanket 44 may be tuned to one another to help improve both the effectiveness and the efficiency of heater 40.

While the characteristics of heater 40 will vary depending on the particular printing application, it is expected that a heater 40 delivering a heat energy greater than 3 mJ/mm$^2$ will be adequate for the desired ink transformation. Printing tests indicate that 5 mJ/mm$^2$ (or more) per square meter of ITM blanket should be sufficient in many LEP ITM heating implementations for effective ink transformation to maintain good print quality. For example, it is expected that focused heating at an energy density greater than 3 mJ/mm$^2$ of printing area will be sufficient in many LEP printing processes to raise the temperature of the exterior surface of an ITM blanket 150° C. or more in less than 10 ms (much less under some operating conditions—40 μms in the example noted above). Shorter post-heating times reduce the power used for effective ink transformation. Post-heating times may be reduced by shortening the distance between heater 40 and nip 59 or speeding up the ITM. Additional energy savings may be realized by turning off heater 40 when there is no ink on blanket 44 at band 56, for example at the seam area of the blanket.

Figure 5:
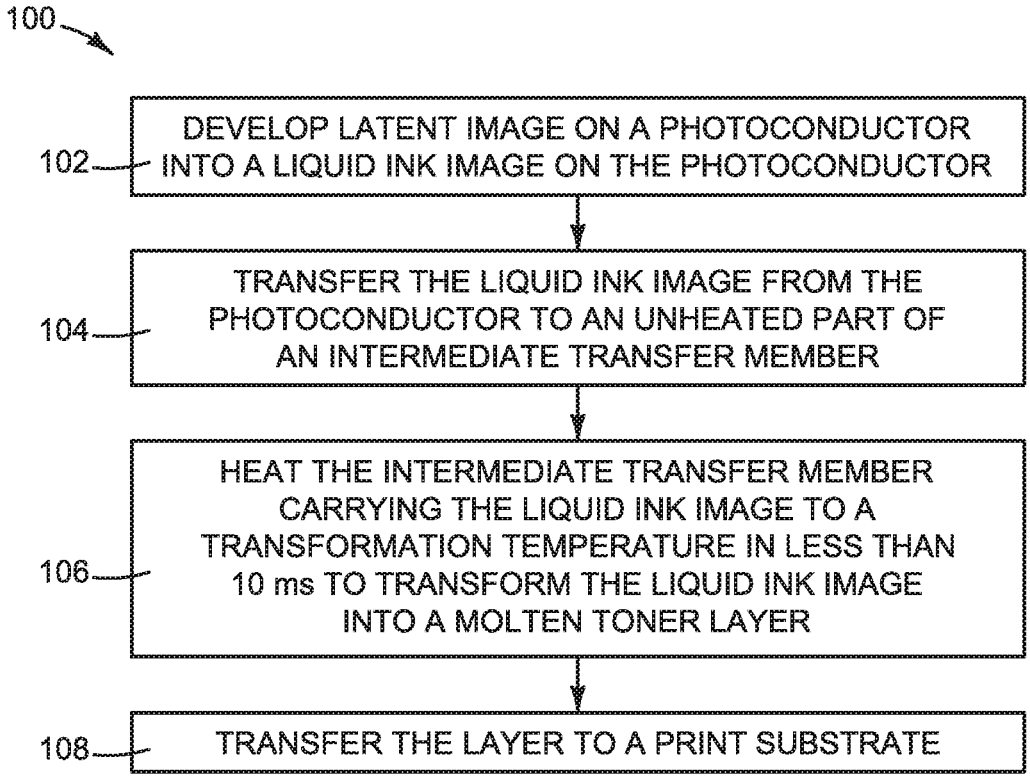
FIG. 5 is a flow diagram illustrating one example of an LEP printing process such as might be implemented in the printer shown in FIGS. 1 and 2.
Figure 6:
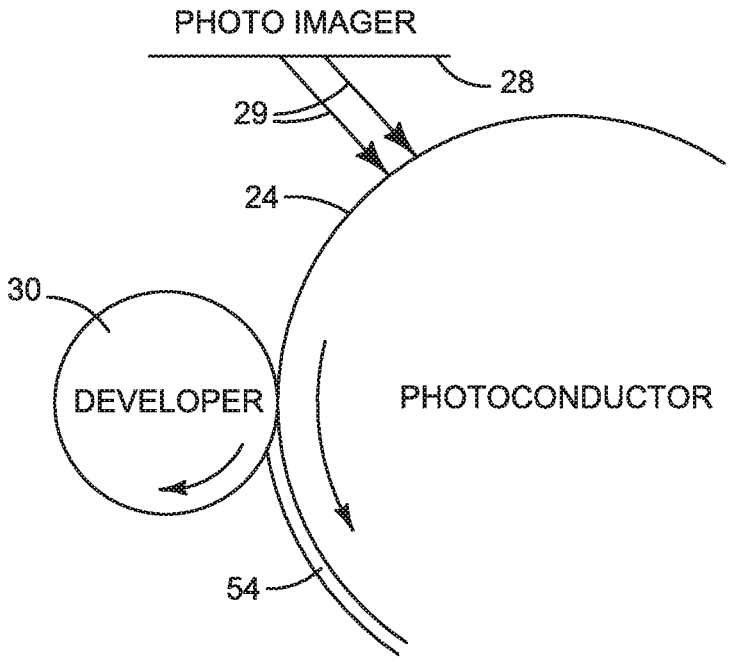
FIGS. 6-9 illustrate one example for the process in the flow diagram of FIG. 5 using the print engine components from FIG. 1.
Figure 7:
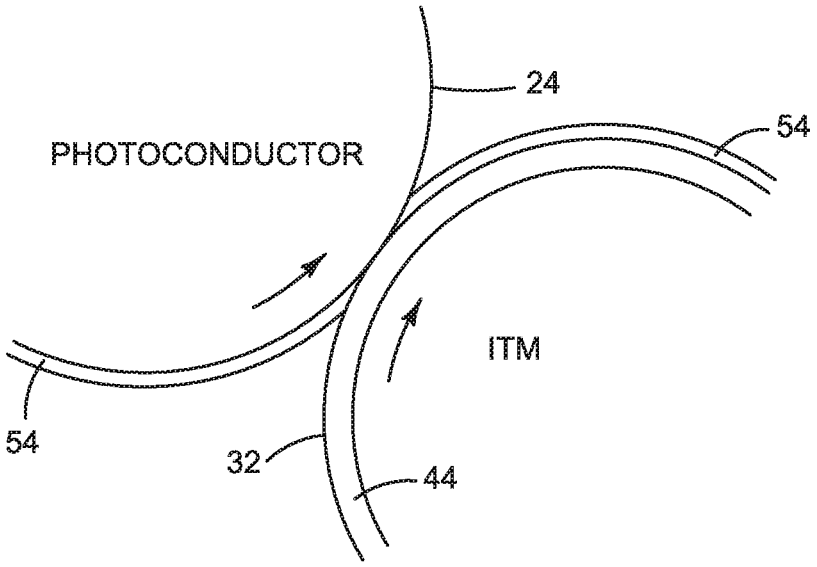

FIG. 5 is a flow diagram illustrating one example of an LEP printing process 100 such as might be implemented in printer 10 shown in FIG. 1. FIGS. 6-9 illustrate the process in the flow diagram of FIG. 5 using the print engine components from FIG. 1. Referring to FIG. 5, a latent image on a photoconductor 24 is developed into a liquid ink image 54 (block 102), for example as shown in FIG. 6, and transferred to an unheated part of an ITM 32 (block 104), for example as shown in FIG. 7. ITM 32 carrying liquid ink image 54 is heated to the desired transformation temperature in less than 10 ms to transform the liquid ink image 54 into a molten toner layer 58 (block 106), for example by exposing ITM blanket 44 to a laser beam 52 as shown in FIG. 8.

Layer 58 is then transferred to a print substrate 34 (block 108), for example as shown in FIG. 9. In other examples, it may be desirable to maintain ITM 32 at a temperature above the unheated, ambient temperature to further reduce laser exposure time and/or the requisite laser power.

Figure 10:
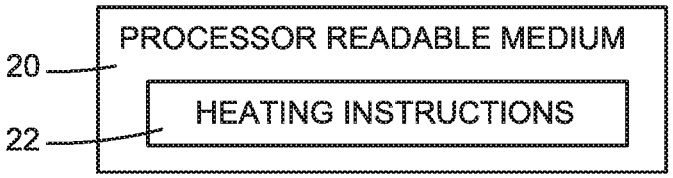
FIG. 10 is a block diagram illustrating one example of a processor readable medium with instructions for heating an ITM in an LEP printer.

FIG. 10 is a block diagram illustrating a processor readable medium 20 with instructions 22 for heating an intermediate transfer member in an LEP printer. Processor readable medium 20 may reside, for example, in controller memory 18 for execution by processor 16 as shown in FIG. 1. Heating instructions 22 may include instructions to transform a liquid ink image 54 into a tacky layer of toner 58 in less than 10 ms, for example by heating an ITM 32 to the desired transformation temperature shown at block 106 in FIG. 5. Instructions 22 may include other LEP printing instructions, for example instructions to develop and transfer shown at blocks 102, 104 and 108 of FIG. 5.

"A" and "an" as used in the Claims means one or more.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

The invention claimed is:

1. A system for transferring an image from a photoconductor to a print substrate, the system comprising:

a rotatable transfer member having a light absorbing exterior surface to receive a liquid LEP ink image from the photoconductor and to release a layer of molten toner to a print substrate; and a laser to, as the transfer member rotates, expose a width of the exterior surface of the transfer member carrying a liquid LEP ink image to a beam of coherent light delivering enough power to transform the liquid LEP ink image into molten toner.

2. The system of claim 1, where the laser is to expose the width of the exterior surface of the transfer member to a beam of coherent light having an energy density at least 3 $mJ/mm^2$.

3. The system of claim 1, where the laser is to deliver enough power to heat the width of the exterior surface of the transfer member to a temperature of 180° C. to 220° C. in less than 10 ms.

4. The system of claim 1, where the laser is to deliver enough power to raise the temperature of the width of the exterior surface of the transfer member at least 150° C. in less than 10 ms.

5. A printing process, comprising:

developing a latent image on a photoconductor into a liquid LEP ink image on the photoconductor;

transferring the liquid LEP ink image on the photoconductor to an unheated part of a moving transfer member;

exposing a part of the moving transfer member carrying the LEP ink image to a beam of coherent light with enough power to transform the liquid LEP ink image into molten toner; and transferring the molten toner to a moving print substrate within 30 ms after exposing the part of the moving transfer member carrying the LEP ink image to the light.

6. The printing process of claim 5, where the exposing includes exposing an exterior surface of the moving transfer member to a beam of coherent light having an energy density at least 3 $mJ/mm^2$.

7. A processor readable medium having instructions thereon that, when executed as part of an LEP printing process:

develop a latent image on a photoconductor into a liquid LEP ink image on the photoconductor;

transfer the liquid LEP ink image on the photoconductor to an unheated part of a moving transfer member;

expose a part of the moving transfer member carrying the LEP ink image to a beam of coherent light with enough power to transform the liquid LEP ink image into molten toner; and transfer the molten toner to a moving print substrate within 30 ms after exposing the part of the moving transfer member carrying the LEP ink image to the light.

8. The processor readable medium of claim 7, where the instructions to expose include instructions to expose an exterior surface of the moving transfer member to a beam of coherent light having an energy density at least 3 $mJ/mm^2$.

9. An LEP printer controller that includes the processor readable claim 7.

* * * * *